United States Patent [19]

Laverty

[11] 4,323,202

[45] Apr. 6, 1982

[54] ADAPTOR CORE

[75] Inventor: Gerald C. Laverty, Santa Clara, Calif.

[73] Assignee: Cosco Industries, Inc., Spring Valley, N.Y.

[21] Appl. No.: 34,966

[22] Filed: May 1, 1979

[51] Int. Cl.[3] ..... B65H 75/02

[52] U.S. Cl. ..... 242/68.5

[58] Field of Search ..... 242/68.3, 68.5, 68.2, 242/72.1; 403/309, 371

[56] References Cited

U.S. PATENT DOCUMENTS

| | | | |
|---|---|---|---|
| 3,860,191 | 1/1975 | Geri | 242/68.5 |
| 4,119,280 | 10/1978 | Sato | 242/68.5 |
| 4,149,974 | 4/1979 | Bolton | 403/371 |

*Primary Examiner*—Edward J. McCarthy
*Attorney, Agent, or Firm*—Senniger, Powers, Leavitt and Roedel

[57] ABSTRACT

An adaptor core for rotatably mounting a coreless roll of labels or the like on the spindle of a labeling gun of the type designed to accept only cored rolls of labels. The adaptor core comprises a hollow generally cylindrical body of one-piece construction having a central circular opening therein, and a series of relatively thin resilient fingers formed integrally with the body and extending laterally outwardly therefrom at the periphery of the body. The core is placed in the central opening of a coreless roll of labels with the fingers engaging the roll and being sprung inwardly by the roll. The outward springing force exerted by the fingers against the roll is sufficient to secure the body in place relative to the roll with the opening in the body generally concentric with the opening in the roll for receiving the spindle of the labeling gun thereby to rotatably mount the adaptor core and roll on the spindle.

4 Claims, 7 Drawing Figures

ADAPTOR CORE

BACKGROUND OF THE INVENTION

This invention relates generally to label printing and applying apparatus and more specifically to means for mounting coreless rolls of labels on hand-held, hand-operated labeling guns of the type described in my pending coassigned U.S. continuation-in-part application Ser. No. 854,391, filed Nov. 23, 1977.

Labeling guns of the type described in the aforesaid application are designed to accept only cored rolls of labels, that is, rolls wound on a cylindrical core of molded plastic or cardboard tubing. The core is formed with a central circular opening therein having a diameter slightly greater than the diameter of the spindle of the labeling gun so that the roll may be readily mounted on the gun for application of the labels to merchandise and the like. After the roll has been exhausted, the core is removed from the spindle and replaced by a new cored roll. The old core is simply discarded. This of course is uneconomical, and the fact that a separate core is required for each roll of labels increases the cost of the rolls, and the shipping expense thereof. Thus there are very substantial advantages to converting to the manufacture and use of coreless rolls of labels. In order to enjoy the advantages of such coreless rolls, new labeling guns could be designed and manufactured which would accept these coreless rolls. However, the cost of manufacturing and supplying such new guns to replace all the existing guns would be uneconomical and, moreover, such new guns would not be compatible as they would be unable to accept cored rolls which presently constitute the greater part of all available rolls in the user's stock. Further, the large number of existing labeling guns which are designed to accept only cored rolls would be obsolete and the substantial investment in them would be lost.

Reference may be made to U.S. Pat. Nos. 3,222,242 and 2,282,016 disclosing means for mounting coreless rolls on various apparatus.

SUMMARY OF THE INVENTION

Among the several objects of this invention may be noted the provision of an adaptor core which enables a coreless roll of labels readily to be mounted on the spindle of a labeling gun designed to accept only cored rolls of labels; the provision of such an adaptor core which is reusable with successive coreless rolls of labels for mounting the latter on the aforesaid labeling gun; the provision of such a core which automatically allows for minor variations in diameter and roundness of the central circular opening in the coreless rolls; the provision of such a core which, upon placement into the central opening of a coreless roll of labels, remains securely in place relative to the roll during dispensing of labels from the roll; and the provision of such a core which is economical to produce and durable in use.

Generally, an adaptor core of this invention is adapted to rotatably mount a coreless roll of labels or the like on the spindle of labeling apparatus, such as a labeling gun, of the type adapted for receiving only cored rolls of labels. The adaptor core comprises a hollow generally cylindrical body of one-piece construction having a central circular opening therein, and a series of relatively thin resilient fingers formed integrally with the body and extending laterally outwardly therefrom at the periphery of the body. The core is adapted to be placed in the central opening of a coreless roll of labels with the fingers engaging the roll and being adapted to be sprung inwardly by the roll. The outward springing force exerted by the fingers against the roll is sufficient to secure the body in place relative to the roll with the opening in the body generally concentric with the opening in the roll for receiving the spindle of the labeling gun thereby to rotatably mount the adaptor core and roll on the spindle. Other objects and features will be in part apparent and in part pointed out hereinafter.

BRIEF DESCRIPTION OF THE DRAWINGS

Corresponding reference characters illustrate corresponding parts throughout the several views of the drawings.

DESCRIPTION OF A PREFERRED EMBODIMENT

Figure 1:
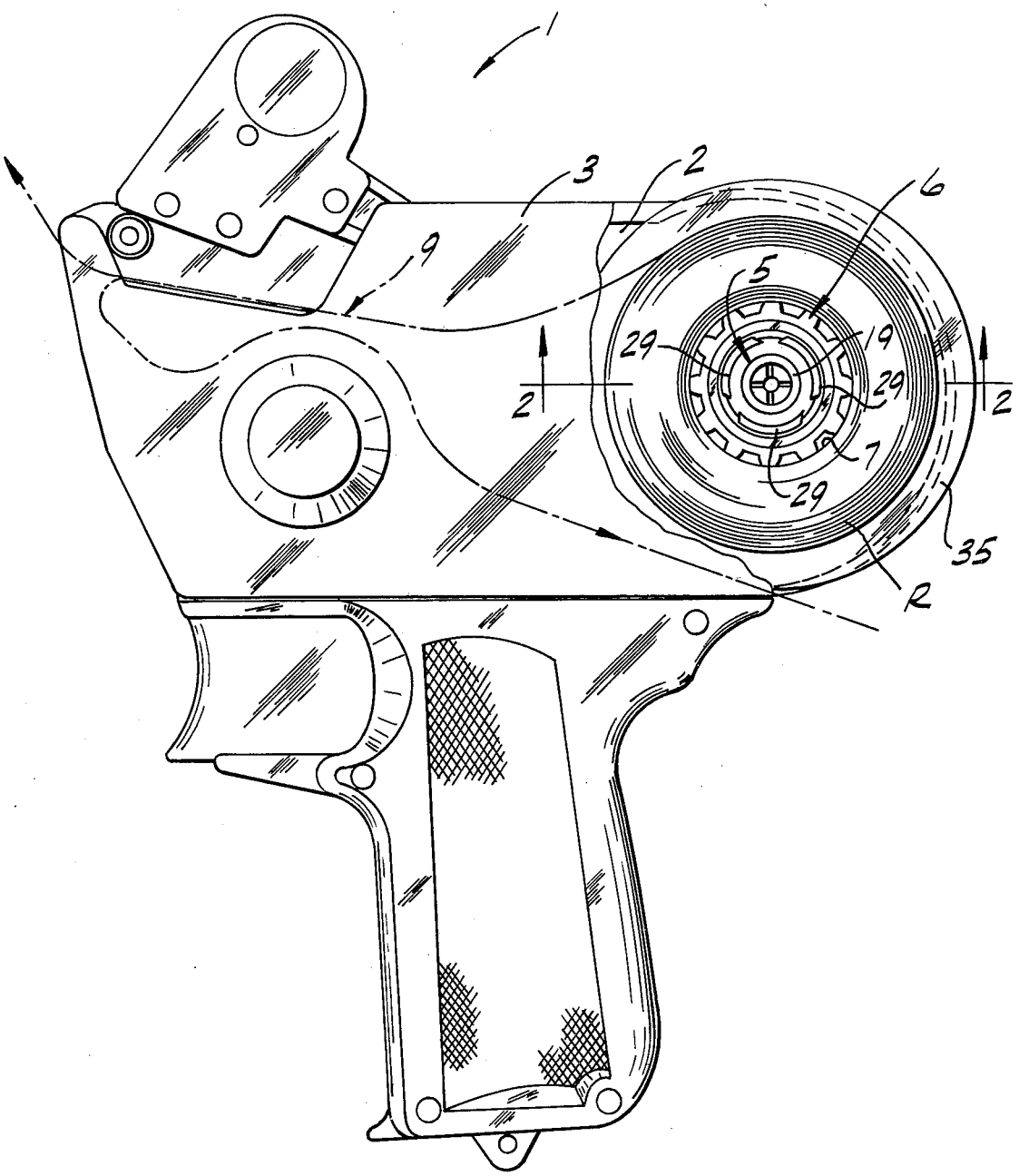
FIG. 1 is a side elevation of a labeling gun with part of a removable side cover of the gun broken away to illustrate an adaptor core of this invention mounting a coreless roll of labels on the spindle of the gun.
Figure 2:
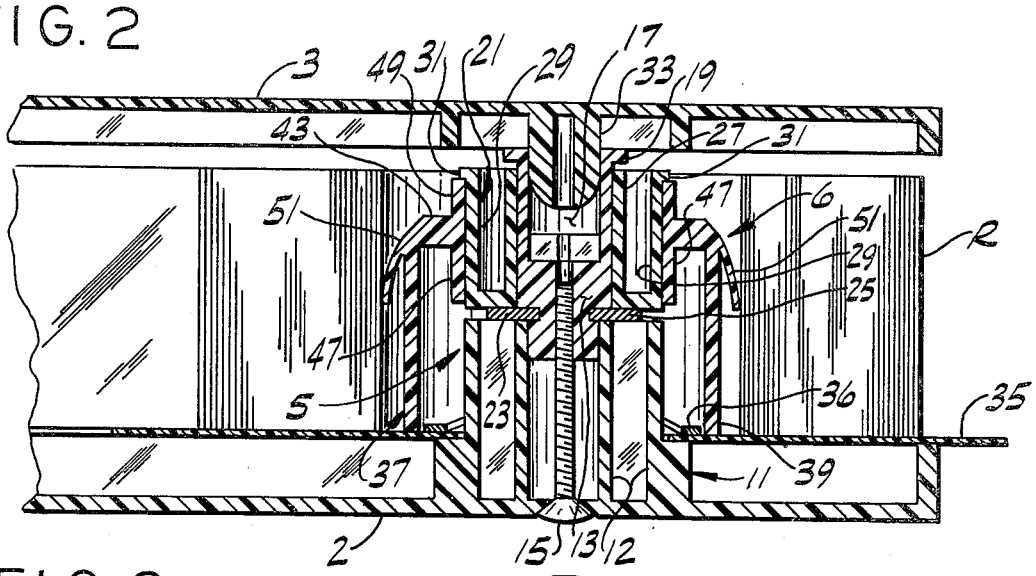
FIG. 2 is an enlarged vertical section taken on line 2—2 of FIG. 1, the portions broken away in FIG. 1 being shown in this view.

Referring now to the drawings, particularly to FIGS. 1 and 2, hand-held and hand-operated label printing and applying apparatus (referred to as a labeling gun) of the type fully described in my aforementioned pending continuation-in-part application is indicated in its entirety by the reference numeral 1. This labeling gun, which is sold by Garvey Labelmatic of Maryland Heights, Mo. under the trade designation LABELMATIC 5000, has a main frame 2 preferably of molded plastic, a removable side cover 3, and a spindle 5 on the main frame which is of the type designed to accept conventional cored rolls of labels. However, in accordance with the present invention, means constituted by an adaptor core, indicated generally at 6, is provided for enabling a coreless roll R of labels to be mounted on the spindle. This roll R, which has a circular central opening 7 therein, is constituted by a series of adhesive-backed labels on a continuous backing tape and is formed without a core in its central opening. The tape and labels thereon are drawn from the roll and fed through the gun along a path 9, as indicated by the arrows in FIG. 1, where the labels are printed and then dispensed for application to the package or other item to be labeled.

The spindle 5 of the labeling gun is formed in three separate parts, the first being an inner circular base 11 (FIG. 2) comprising a pair of concentric tubular members 12 integrally molded with the plastic frame 2 of the gun, and the second being a cylindric plastic guide post 13, the inner (lower) end of which is received in the central tubular member 12 of the base. The post is secured to the base by a self-tapping screw 15 extending up through the frame of the gun and threaded into the lower end of the post. As indicated at 17, the outer (upper) end of the post is recessed and formed with a peripheral flange 19. The spindle further comprises a plastic rotary member, generally designated 21, journalled on the guide post 13 and bearing on a metal snap ring 23 received in a groove 25 in the lower end of the post above the base 11. This rotary member, which is engagable at its outer (upper) end with flange 19 of the post to hold it captive on the post, comprises an inner hub portion 27 surrounded by three separate flexible upstanding legs, each designated 29, extending axially of the hub portion and being spaced radially outwardly thereof, the legs being curved on arcs centered on the central axis of the rotary member (FIG. 1). Each of the legs 29 has an outwardly-turned lip 31 at its free upper end.

A pin 33 projecting from the removable side cover 3 of the frame of the gun is received in the recess 17 in the upper end of the guide post 13 so as to assist in holding the cover 3 in place on the gun in face-to-face relation with one face (the upper face as viewed in FIG. 2) of the roll R. The other (lower) face of the roll bears on a circular bearing plate 35 journalled on the outer tubular member 12 of base 11 of the spindle and retained in place by a retaining ring 36.

The adaptor core 6 rotatably mounting the coreless roll R of labels on the spindle 5 of the labeling gun comprises a hollow generally cylindrical body 37 open at both ends and molded of a suitable plastic, i.e., a synthetic resin material, such as polypropylene, although it will be understood that it may also be formed from metal, as by stamping. This body 37 is generally symmetrical about its central vertical axis and comprises a generally cylindric main body portion 39 relatively large in diameter, a generally cylindric hub portion 41 of smaller diameter at one end (the upper end as viewed in FIGS. 2 and 3) of the main body portion, and an annular shoulder 43 joining the main body and hub portions 39, 41. The hub portion 41, which has a central circular opening 45 therein somewhat larger in diameter than that of the circle formed by the upstanding legs 29 of the spindle but smaller in diameter than the circle defined by the out-turned lips 31 at the upper ends of the legs 29, is concentric with the main body portion 39 and comprises a first inner section 47 inside the main body portion, and a second outer section 49 extending up endwise from the main body portion. As shown, the spindle 5 of the gun is received in the central circular opening 45 of the hub, with the main body portion 39 on the core bearing on the circular bearing plate 35. The outer section 49 of the hub portion 41 of the adaptor core is in underlying engagement with lips 31 of the upstanding legs 29 for retaining the adaptor core on the spindle.

Figure 3:
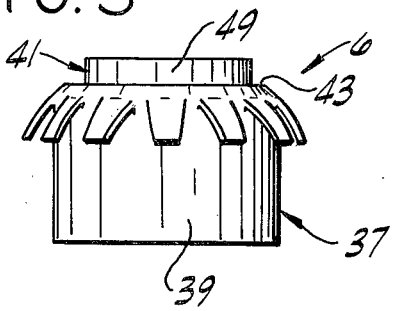
FIG. 3 is a side elevation of the core shown in FIGS. 1 and 2.
Figure 4:
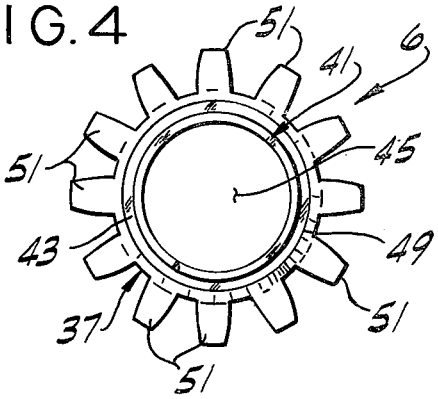
FIG. 4 is a plan of FIG. 3.

As shown in FIGS. 3 and 4, the adaptor core further comprises a series of relatively thin (e.g., 0.015 inches or 0.38 mm.) resilient teeth or fingers, each designated 51, molded integrally with the body 37 and extending radially outwardly therefrom at the periphery of the body. More particularly, the fingers are coned (inclined) downwardly from the top of the cylindric main body portion 39 of the core at a suitable angle (e.g., 45°) and the sides of each finger are convergent toward the outer end of the finger. The outer edges of the fingers, when unflexed, lie on a circle having a diameter (e.g., 1.285 inches or 32.64 mm.) greater than that of the central circular opening 7 of roll R (which typically is about 1.15 inches or 29.21 mm. in diameter) so that on placement of the adaptor core in the central opening in the roll the fingers engage the inner cylindric surface of the roll and are sprung downwardly and inwardly thereby toward the main body portion 39. The outward springing force exerted by the fingers against the roll (at points generally in the central radial plane of the roll) is sufficient to secure the adaptor core in place relative to the roll with the central opening 45 in the hub portion 41 of the core generally concentric with the opening 7 in the roll R. Thus the adaptor core and roll rotate as a unit on the spindle.

It will be noted that since the spring fingers 51 act independently of each other, they automatically allow for minor variations in diameter and roundness of the central opening 7 in roll R.

The adaptor core 6 of this invention enables a coreless roll of labels, such as roll R, to be mounted on a spindle 5 which is designed to accept conventional cored rolls of labels. To accomplish this, the side cover 3 is removed from the frame and the adaptor core 6 is pushed onto the spindle with the latter entering the central opening 45 in hub portion 41 of the adaptor core. During this process, the resilient upstanding legs 31 flex inwardly toward the guide post 13 since the diameter of the circle defined by the lips 31 at the upper ends of the upstanding legs 29 is greater than that of the central opening 45. As the adaptor core is pushed completely on the spindle to the position shown in FIG. 2, the legs 29 of the spindle snap back to their unflexed position with lips 31 overlying the hub portion of the adaptor core to lock it on the spindle. The roll R is then pushed on the adaptor core with the core received in the central opening 7 in the roll. During this operation, spring fingers 51 of the core engage the inner cylindrical surface of the roll and are sprung downwardly and inwardly toward the main body portion 39 of the core, the outward spring force exerted by the fingers against the roll being sufficient to provide a positive interlock between the core and the roll to inhibit relative rotational movement therebetween. The above-described process may, of course, be reversed with the adaptor core first being inserted into the central opening in the roll R and the roll and core then being placed as a unit on the spindle. After the adaptor core 6 and roll R are on the spindle, the side cover 3 is replaced on the frame with pin 33 projecting into the recess 17 at the outer end of the guide post 13 of the spindle.

When roll R has been exhausted, leaving only the adaptor core 6 on the spindle, the side cover 3 is removed and a new coreless roll may readily be mounted on the adaptor core. Or, alternatively, the adaptor core may be slipped off the spindle and a conventional cored roll of labels mounted thereon. Thus, by using adaptor core 6, both cored and coreless rolls of labels may be used interchangeably on the gun without modification to the gun.

Figure 5:
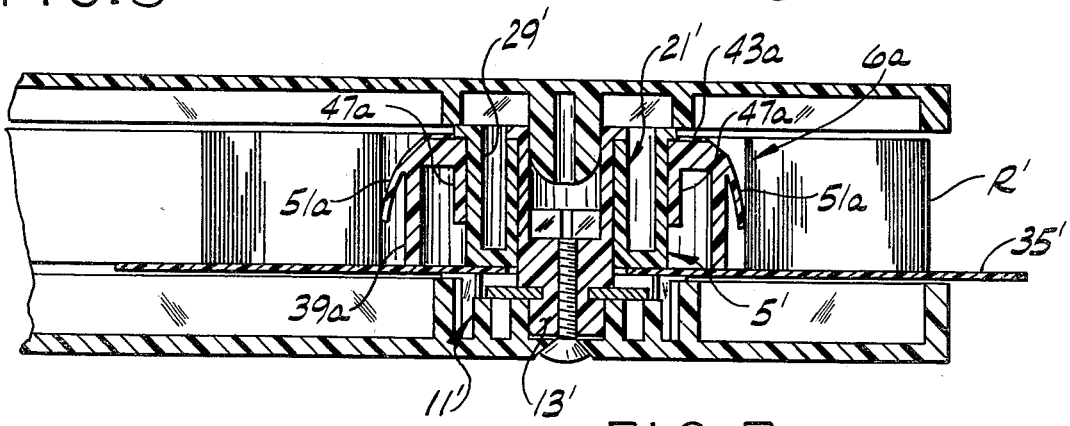
FIG. 5 is a view similar to FIG. 2 showing an alternative adaptor core of this invention.
Figure 6:
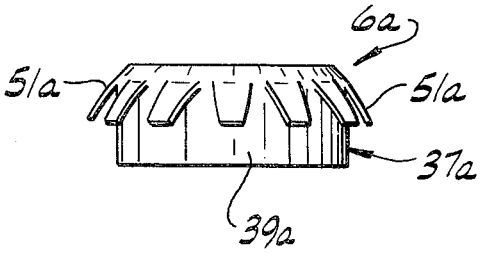
FIG. 6 is a side elevation of the alternative adaptor core shown in FIG. 5.
Figure 7:
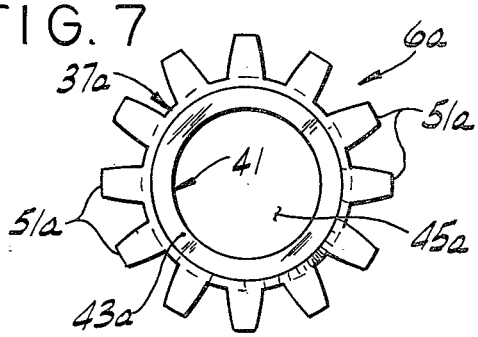
FIG. 7 is a plan of FIG. 6.

Referring now to FIGS. 5–7, an alternative adaptor core of this invention is designated generally **6*a* to distinguish it from adaptor core 6. This adaptor core 6*a* is designed to mount a roll R′ of relatively narrow labels (as compared to the labels of roll R) on the spindle of a labeling gun constructed to accept such rolls, such as the labeling gun shown in FIG. 5 which is sold by Garvey Labelmatic of Maryland Heights, Mo. under the trade designation LABEL-MATIC 4500. Inasmuch as the spindle of the labeling gun shown in FIG. 5 is similar in construction to the spindle 5 described above, the parts thereof corresponding to those of spindle 5 are given the same reference numerals with the prime (') superscript. In like fashion, core 6***a* is similar in construction to the adaptor core 6 described hereinabove and the parts thereof corresponding to those of core 6 are given the same reference characters followed by the letter "a". Adaptor core 6*a* differs from core 6 shown in FIGS. 1–4 in that the axial dimension of the main body portion 39*a* of body 37*a* is reduced for enabling the core to properly fit a relatively short spindle, such as spindle 5', and in that the hub portion 41*a* comprises only a first section 47*a* extending down from the shoulder 43*a* inside the main body portion 39*a*, the second outer section 49 of adaptor core 6 being eliminated. Otherwise, adaptor core 6*a* is essentially identical to core 6 as previously described.

For mounting coreless rolls of extra-wide labels on a relatively long spindle, two or more adaptors 6, 6*a* of this invention stacked one atop another may be used.

In view of the above, it will be seen that the several objects of the invention are achieved and other advantageous results attained.

As various changes could be made in the above constructions without departing from the scope of the invention, it is intended thawt all matter contained in the above description or shown in the accompanying drawings shall be interpreted as illustrative and not in a limiting sense.

What is claimed is:

1. An adaptor core for rotatably mounting a coreless roll of labels or the like of the spindle of labeling apparatus, such as a labeling gun, of the type adapted for receiving only cored rolls of labels, said adaptor core comprising a hollow generally cylindrical body of one-piece construction having a generally cylindrical main body portion relatively large in diameter, a generally cylindrical hub portion of smaller diameter at one end of the main body portion, an annular shoulder portion joining the main body and hub portions, said hub portion having a central circular opening therein for receiving said spindle, and a series of relatively thin resilient fingers formed integrally with the body and extending radially outwardly therefrom at the periphery of the body, said core being adapted to be placed in the central opening of a coreless roll of labels with said fingers engaging the roll and being adapted to be sprung inwardly by the roll, the outward springing force exerted by the fingers against the roll being sufficient to secure the body in place relative to the roll with the opening in the body generally concentric with the opening in the roll for receiving said spindle thereby to rotatably mount the adaptor core and roll on the spindle.

2. An adaptor core as set forth in claim 1 wherein said fingers are at said one end of the main body portion of said body and are coned toward the other end of the main body portion.

3. An adaptor core as set forth in claim 1 wherein said cylindric hub portion is generally concentric with said main body portion and comprises a first section extending inside the main body portion.

4. An adaptor core as set forth in claim 3 wherein said hub portion comprises a second section extending from the main body portion endwise of the latter.

* * * * *